US006969444B2

(12) United States Patent
Linhart et al.

(10) Patent No.: US 6,969,444 B2
(45) Date of Patent: Nov. 29, 2005

(54) PAPER COATING SLIP CONTAINING N-VINYLFORMAMIDE

(75) Inventors: Friedrich Linhart, Heidelberg (DE); Bernd Dirks, Hessheim (DE); Heinrich Ullrich, Freinsheim (DE); Thierry Blum, Neustadt (DE); Norbert Mahr, Limburgerhof (DE); Stefan Frenzel, Mannheim (DE); Martin Wendker, Worms (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/415,338

(22) PCT Filed: Nov. 2, 2001

(86) PCT No.: PCT/EP01/12685

§ 371 (c)(1),
(2), (4) Date: May 2, 2003

(87) PCT Pub. No.: WO02/38861

PCT Pub. Date: May 16, 2002

(65) Prior Publication Data

US 2004/0020615 A1 Feb. 5, 2004

(30) Foreign Application Priority Data

Nov. 9, 2000 (DE) ..... 100 55 592

(51) Int. Cl.[7] ..... D21H 19/20

(52) U.S. Cl. ..... 162/135; 162/158; 162/162; 162/168.2; 106/499; 427/391; 427/395

(58) Field of Search ..... 162/135, 162, 162/158, 164.6, 168.2; 106/499; 427/391, 395

(56) References Cited

U.S. PATENT DOCUMENTS

| | | | |
|---|---|---|---|
| 3,597,314 | A | 8/1971 | Laube et al. |
| 5,026,507 | A | 6/1991 | Gowan, Jr. et al. |
| 5,145,559 | A | 9/1992 | Hartmann et al. |
| 5,266,078 | A | 11/1993 | Welkener et al. |
| 5,622,749 | A | 4/1997 | Rohringer et al. |
| 5,753,759 | A | 5/1998 | Hartmann et al. |

FOREIGN PATENT DOCUMENTS

| | | |
|---|---|---|
| DE | 197 27 503 | 1/1999 |
| EP | 0 251 182 | 1/1988 |
| EP | 1 022 383 | 7/2000 |
| WO | 00 68501 | 11/2000 |

OTHER PUBLICATIONS

T.W.R. Dean ed.: "The essential guide to aqueous coating of paper and board" Published by The Paper Ind. Techn. Assoc. (PITA) 1997.

*Primary Examiner*—Peter Chin
(74) *Attorney, Agent, or Firm*—Oblon, Spivak, McClelland, Maier & Neustadt, P.C.

(57) ABSTRACT

Paper coating slips whose additives comprise addition polymers or copolymers containing N-vinylformamide in (co) polymerized form, and their use.

15 Claims, No Drawings

PAPER COATING SLIP CONTAINING N-VINYLFORMAMIDE

BACKGROUND OF THE INVENTION

1. Field of the Invention

The invention relates to novel paper coating slips. The invention further relates to the use of paper coating slips and to papers coated with said slips.

2. Description of the Background

Paper coating slips consist essentially of a pigment (usually white), a polymeric binder, and additives which exert the desired influence over Theological properties of the slip and surface properties of the coated paper. Such additives are frequently also referred to as cobinders. The function of the binder is to fix the pigments to the paper and ensure cohesion within the coating obtained.

Slip coating gives base papers a smooth, uniformly white surface. The slips also enhance the printability of the paper.

The coating of paper with slips is nowadays well known; see, for example, "The Essential Guide to Aqueous Coating of Paper and Board", T. W. R. Dean (ed.), published by the Paper Industry Technical Association (PITA), 1997.

One of the most important objectives of the slip coating of paper is to increase the whiteness of the paper. At the same time, however, the surface of the paper must be sufficiently stable that it is not damaged during printing and that the printed image is not impaired.

A host of different measures may be taken to increase the whiteness of the coated paper. These measures include, for example, the use of a base paper of very high whiteness, which in turn can be obtained by using very white starting materials. Another measure is to select very white pigments for the paper coating slip.

These measures alone, however, are in the majority of cases unable to meet the modern-day requirements of users regarding the whiteness of the paper. It is for this reason that products known as whiteners (fluorescent or phosphorescent dyes) or optical brighteners are added to the coating slip. The brighteners are dyelike fluorescent dyes which absorb the shortwave ultraviolet light that is invisible to the human eye and emit it as longer-wave blue light, giving the human eye the impression of a higher whiteness, so that the whiteness is increased.

The use of the optical brighteners, however, only results in the desired outcome if the brighteners are present in an optimum structure, conformation, and distribution in the finished paper coating. To achieve this, polymeric compounds, which intensify the effect of the optical brightener and are referred to as activators or carriers, are added to the slip. An important function of the cobinders—mentioned at the outset—in colored coating slips is their brightener-activating effect. Suitable cobinders may include water-soluble polymers, e.g., polyvinyl alcohol, carboxymethylcellulose, anionic or nonionic degraded starches, casein, soy protein, and water-soluble styrene-acrylate copolymers (see, for example, K. P. Kreutzer, Grundprozesse der Papiererzeugung 2: Grenzflächenvorgänge beim Einsatz chemischer Hilfsmittel, H. -G. Völkel and R. Grenz (editors), PTS Munich, 2000, PTS manuscript: PTS-GPE—SE 2031-2).

However, it is not possible with every water-soluble polymer to activate the optical brightener; for example, with certain polysaccharides, e.g., dextran, or with anionic polyacrylamides, it is not possible to activate the optical brightener. On the contrary, it has long been known that water-soluble polymers containing cationic groups, especially amino or ammonium groups, such as polyamine/epichlorohydrin or polyamidoamine/epichlorohydrin resins, polyamines or polyethyleneimines, for example, not only do not boost the whitener but in fact cause its deactivation, so that the brightening is extinguished (K. P. Kreutzer, loc. cit., page 8–22).

DE-A 197 27 503 discloses paper coating slips which comprise binders containing N-vinylcarboxamide units. The activation of optical brighteners by additives, however, is not described.

It is an object of the present invention to provide paper coating slips having improved properties or leading to an improvement in the coated paper.

SUMMARY OF THE INVENTION

We have found that this object is achieved by the use of paper coating slips having improved properties, these slips including among their additives addition polymers or copolymers containing N-vinylformamide (formula I) in (co)polymerized form.

(I)

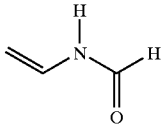

DETAILED DESCRIPTION OF THE PREFERRED EMBODIMENTS

In accordance with the invention it is possible as additives (cobinders) to use addition polymers or copolymers, referred to hereinbelow as (co)polymers, which consist of N-vinylformamide and, respectively, contain N-vinylformamide and also anionic, cationic and/or nonionic monomers in copolymerized form. Moreover, before their use in a paper coating slip of the invention, the polymers or copolymers may be subjected to a cleavage operation in which the carboxylic groups (formyl groups) are partially eliminated.

It is surprising that the addition of water-soluble (co) polymers of vinylformamide brings about extraordinarily great activation of the optical brighteners in paper coating slips. Even more surprising and entirely unexpected, however, is that cationic copolymers of vinylformamide—in contrast to what is stated by K. P. Kreutzer, loc. cit., page 8–22—are likewise suitable as carriers for optical brighteners and indeed boost their activity even more than the nonionic polyvinylformamides. The activation of the whiteners in paper coating slips by (co)polymers of vinylformamide, in accordance with the invention, is much greater than the activity of other cobinders in this respect. In addition to their brightener-activating effect, the (co) polymers incorporated into the paper coating slips possess the property of raising the dry pick resistance and wet pick resistance of the coated paper, and do so to a greater extent than do other cobinders. Furthermore, it has surprisingly been found that papers coated with the slips of the invention produce a higher print gloss than papers coated with slips comprising prior art cobinders.

The preparation of the polymers of N-vinylformamide which may be used for the coating slips of the invention has been known for a long time (see, for example, EP-B1 71 050, corresponding to U.S. Pat. No. 4,421,602).

Cationic copolymers containing N-vinylformamide in copolymerized form may also be used in accordance with the invention.

The preparation of cationic copolymers of N-vinylformamide and a water-soluble basic monomer, such as N-trialkylammoniumalkylacrylamides, N-trialkylammoniumalkylmethacrylamides and/or diallyldialkylammonium salts, for example, and their use as flocculants and dewatering aids for the treatment of wastewaters and sludges, are described in EP-B1 464 043 (corresponding to U.S. Pat. No. 5,225,088).

For example, as a water-soluble cationic monomer, diallyldimethylammonium chloride, diallyldiethylammonium methosulfate, N-(2-trimethylammonium)ethylacrylamide methosulfate or N-2-(ethyldimethylammonium) ethylmethacrylamide ethosulfate or mixtures thereof may be copolymerized with N-vinylformamide as described in EP-B1 464 043, to give cationic copolymers suitable for use in the colored paper coating slips of the invention.

It is of course also possible, for the coating slips of the invention, to use cleaved vinylformamides (see below) in which the liberated, polymer-bound amino functions form an ammonium formate with the eliminated formic acid.

In addition, the preparation of copolymers of N-vinylformamide and monoethylenically unsaturated carboxylic acids having from 3 to 8 carbon atoms and/or their alkali metal, alkaline earth metal or ammonium salts, such as acrylic acid or methacrylic acid, for example, and also, if desired, other ethylenically unsaturated, copolymerizable compounds, and their use as additives to the paper pulp for the purpose of increasing the dewatering rate and the retention in paper making, and also the dry and wet strength of the paper, are known from DE-A1 42 41 117 (corresponding to U.S. Pat. No. 5,630,907) and lead to anionic copolymers which may likewise be used in accordance with the invention for coating slips.

Examples of suitable monomers of monoethylenically unsaturated carboxylic acids having from 3 to 8 carbon atoms, and of the water-soluble salts of these monomers, include the following: acrylic acid, methacrylic acid, dimethylacrylic acid, ethacrylic acid, maleic acid, citraconic acid, methylenemalonic acid, allylacetic acid, vinylacetic acid, crotonic acid, fumaric acid, mesaconic acid, and itaconic acid. From this group of monomers it is preferred to use acrylic acid, methacrylic acid, maleic acid or else mixtures of said carboxylic acids, especially mixtures of acrylic acid and maleic acid or of acrylic acid and methacrylic acid. These monomers or mixtures thereof may be used either in the form of the free carboxylic acids or in partly or fully neutralized form for the copolymerization.

The weight ratio of vinylformamide to monoethylenically unsaturated carboxylic acid having from 3 to 8 carbon atoms and/or alkali metal, alkaline earth metal or ammonium salts thereof in the monomer mixture may range between 100:0 and 70:30, preferred weight ratios being between 100:0 and 80:20, and particularly preferred weight ratios being between 100:0 and 90:10.

Additionally, nonionic copolymers of N-vinylformamide with further water-soluble vinyl monomers may boost the activity of the optical brightener in the paper coating slips of the invention. Further water-soluble vinyl monomers suitable for this purpose include N-vinylpyrrolidone and other N-vinyllactams, such as N-vinylcaprolactam, and also N-vinyl-N-alkylcarboxamides or N-vinylcarboxamides, such as N-vinylacetamide, N-vinyl-N-methylformamide, and N-vinyl-N-methylacetamide, for example. It is also possible to use mixtures of these.

A preferred monomer is N-vinylpyrrolidone.

The composition of the (co)polymers is generally as follows:

N-Vinylformamide:

1–100 parts by weight, preferably 2–80, with particular preference 5–80

Water-soluble cationic monomer:

0–10 parts by weight, preferably 0.5–8, with particular preference 1–5

Acrylic acid or methacrylic acid and/or their salts or mixtures thereof:

0–30 parts by weight, preferably 1–20, with particular preference 2–10

Further water-soluble vinyl monomer:

0–90 parts by weight, preferably 0.5–80, with particular preference 5–50

A method frequently used, but not the only one, for preparing the abovementioned (co)polymers is that of free-radical (co)polymerization in a solvent or diluent.

The free-radical (co)polymerization of such monomers takes place, for example, in aqueous solution in the presence of polymerization initiators which break down into free radicals under polymerization conditions. The (co) polymerization may be performed within a wide temperature range, where-appropriate at subatmospheric or superatmospheric pressure, generally at temperatures up to 100° C. The pH of the reaction mixture is commonly adjusted so as to be within the range from 4 to 10.

The (co)polymerization may also, however, be conducted in other ways known per se to the skilled worker, for example, as a solution, precipitation, water-in-oil emulsion or inverse suspension polymerization. Solution polymerization is preferred.

The N-vinylformamide is (co)polymerized using free-radical polymerization initiators, examples being azo compounds that break down into free radicals, such as 2,2'-azobis(isobutyronitrile), 2,2'-azobis(2-amidinopropane) hydrochloride or 4,4'-azobis(4'-cyanopentanoic acid).

Said compounds are usually used in the form of aqueous solutions, the lower concentration being determined by the amount of water that is acceptable in the (co)polymerization and the upper concentration being determined by the solubility of the respective compound in water. In general, the concentration is from 0.1 to 30% by weight, preferably from 0.5 to 20% by weight, with particular preference from 1.0 to 10% by weight, based on the solution.

The amount of the initiators is generally from 0.1 to 10% by weight, preferably from 0.5 to 5% by weight, based on the monomers to be (co)polymerized. It is also possible to use two or more different initiators in the (co) polymerization.

Examples of solvents or diluents used include water, alcohols, such as methanol, ethanol, n- or iso-propanol, n- or iso-butanol, or ketones, such as acetone, ethyl methyl ketone, diethyl ketone or iso-butyl methyl ketone.

If desired, the (co)polymerization may be conducted in the presence of polymerization regulators, such as hydroxylammonium salts, chlorinated hydrocarbons, and thiocompounds, such as tert-butyl mercaptan, 2-ethylhexyl thioglycolate, mercaptoethynol, mercaptopropyltrimethoxysilane, dodecyl mercaptan, and tert-dodecyl mercaptan, or alkali metal hypophosphites. In the (co)polymerization these regulators may be used, for example, in amounts of from 0 to 0.8 part by weight per 100 parts by weight of the monomers to be (co)polymerized, and have the effect of reducing the molar mass of the resultant (co)polymer.

In the case of emulsion polymerization, ionic and/or nonionic emulsifiers and/or protective colloids or stabilizers are used as surface-active compounds.

Depending on the polymerization conditions, the (co) polymerization produces (co)polymers of varying molecular weights, the molecular weight being characterized in EP-B1 71 050 and below using the Fikentscher K values (measured in 0.5% strength by weight aqueous sodium chloride solution at 25° C.). (Co)polymers having a high K value, of above 80, for example, are preferably prepared by (co) polymerizating N-vinylformamide in water. (Co)polymers having a high K value with high molecular weights are obtained, furthermore, by (co)polymerizing the monomers in the form of inverse suspension polymerization or by (co)polymerizing the monomers by the technique of water-in-oil polymerization, for example.

In the case of the process of inverse suspension polymerization and that of water-in-oil polymerization, the oil phase used comprises saturated hydrocarbons, examples being hexane, heptane, cyclohexane, and decalin, or aromatic hydrocarbons, such as benzene, toluene, xylene, and cumene. The ratio of oil phase to aqueous phase in the case of inverse suspension polymerization is, for example, from 10:1 to 1:10.

(Co)polymers having a low K value, of below 80, for example, are obtained if the (co)polymerization is conducted in the presence of polymerization regulators or in a solvent that regulates the (co)polymerization, examples being alcohols, such as methanol, ethanol, n- or iso-propanol, or ketones, such as acetone, ethyl methyl ketone, diethyl ketone or iso-butyl methyl ketone.

K values of low molecular weights and correspondingly low K values are also obtained by means of the customary methods, i.e., use of relatively large amounts of polymerization initiator or of polymerization regulators, or combinations of said measures.

The molecular weight of the (co)polymers that can be used in accordance with the invention is not restricted; however, it should not be too high, so that the coating slip does not have too high a viscosity. Preference is given to (co)polymers having K values of between 10 and 80, with K values between 30 and 70 being particularly preferred.

In accordance with the invention, vinylformamide (co) polymers may be used either in partially or fully cleaved form or else in uncleaved form. Preference is given to a degree of hydrolysis of between 0 and 30%, with particular preference between 0 and 20%, and with very particular preference between 0 and 10%. The nature of the elimination of the formyl group is not restricted, and elimination may be performed, for example, in the presence of acid or base; preference is given to cleavage in the presence of bases, such as sodium hydroxide, potassium hydroxide, alkaline earth metal hydroxides, ammonia or amines, for example. In this case, partial hydrolysis of, for example, a copolymer containing (meth)acrylates and vinylformamides in copolymerized form may give rise to amphoteric (co) polymers.

In a particularly simple way, however, cationic copolymers of vinylformamide are obtained by cleaving homopolymers of vinylformamide hydrolytically to the desired degree of hydrolysis using defined amounts of acid or base, as described in EP-B1 071 050. Depending on the pH of the solution, the amino groups which are formed on the polymer chain are more or less protonated and so give the polymer a more or less cationic character.

If it is desired to eliminate the formyl group, this may be done in water.

The elimination of the formyl group in the hydrolysis takes place at temperatures in the range from 20 to 200° C., preferably from 40 to 180° C., in the presence or absence of acids or bases. The hydrolysis is preferably conducted within the temperature range from 70 to 90° C.

For the acidic hydrolysis, from about 0.05 to 1.5 equivalents of an acid, such as hydrochloric acid, hydrobromic acid, phosphoric acid or sulfuric acid, are required per formyl group equivalent in the poly-N-vinylformamide. The pH for the acidic hydrolysis is in the range from 2 to 0, preferably from 1 to 0. The hydrolysis proceeds with substantially greater rapidity than that of (co)polymers of other N-vinylcarboxamides, such as N-methyl-N-vinylformamide, for example, and may therefore be conducted under more gentle conditions, i.e., at lower temperatures and without a large excess of acids.

Furthermore, the hydrolysis of the formyl groups of the poly-N-vinylformamide may also be carried out in an alkali medium, in the pH range from 11 to 14, for example. This pH is preferably set by adding sodium hydroxide or potassium hydroxide solution. It is, however, also possible to use ammonia, amines and/or alkaline earth metal bases. From 0.05 to 1.5, preferably from 0.4 to 1.0, equivalent(s) of a base is (are) used for the alkaline hydrolysis.

The cleavage may also be carried out at high temperatures, for example, above 100° C., preferably from 120 to 180° C., with particular preference from 140 to 160° C., in the presence of a solvent, e.g., water, without acid or base. This is preferably done under conditions above the critical point, using supercritical water, for example.

In the course of the hydrolysis—i.e., the formyl group is eliminated from the poly-N-vinylformamide in water in the presence of acids or bases—the byproduct comprises formic acid and/or salts of formic acid.

The resulting solutions may be used without further workup, or else the hydrolysis and/or solvolysis products may be separated off.

For separation, the solutions obtained are treated using ion exchangers, for example. The residue separated from the hydrolysis products may then be incorporated into the coating slips.

The amount of vinylformamide (co)polymers added to the paper coating slip of the invention is guided by the amount of brightener in the slip.

Normally, from 0.2 to 2 parts by weight of optical brightener per 100 parts by weight of pigment are added to the coating slip. The amount of (co)polymer added to the coating slip is normally equal to from 1 to 5 times the amount of the optical brightener, i.e., from 0.2 to 10 parts by weight, preferably from 0.5 to 8 parts by weight, and with particular preference from 1 to 5 parts by weight.

The paper coating slips of the invention preferably comprise at least one optical brightener.

The coating slips of the invention are processed completely in analogy to processing of coating slips in accordance with the prior art, e.g., in accordance with "The Essential Guide to Aqueous Coating of Paper and Board", T. W. R. Dean (ed.), Published by the Paper Industry Technical Association (PITA), 1997 or "Ratgeber für die Verwendung von BASF-Erzeugnissen in der Papier-und und Kartonstreicherei", BASF Aktiengesellschaft, D-6700 Ludwigshafen, Federal Republic of Germany, B 376 d, 09.77.

Besides the additive of the invention, the paper coating slips of the invention further comprise at least one white pigment and at least one binder.

The paper coating slips may further comprise other ingredients known to the skilled worker. Suitable examples include leveling assistants, pigment wetting aids, etc.

There is no restriction of the optical brighteners that may be used in connection with the coating slips of the invention. It is possible to use the commercially customary stilbene derivatives substituted by up to 6 sulfonic acid groups, an example being Blankophor® PSG from Bayer AG, or derivatives thereof, or 4,4'-distyrylbiphenyl derivatives.

The pigments that may be used in the coating slips of the invention are likewise not subject to any restriction. For example, use may be made of satin white (calcium sulfoaluminate), calcium carbonate in ground or precipitated form, barium sulfate in ground or precipitated form, kaolin (clay), calcined clay, talc, silicates, chalk or coating clay, or organic pigments, e.g., plastics in particle form.

Nor is there any restriction on the binders ((co)polymeric binders) that may be used in the coating slips of the invention. For example, casein, starch, soy protein, carboxymethylcellulose, alginate and/or polyvinyl alcohol or dispersions containing acrylic acid, acrylates, vinyl acetate and/or styrene in copolymerized form, e.g., (co) polymers of acrylate/styrene, styrene/butadiene or vinyl acetate, may be used. The paper coating slips may further comprise, for example, dispersants. Suitable dispersants are polyanions, for example those of polyphosphoric acids or of polyacrylic acids (polysalts), which are normally present in amounts of from 0.1 to 3% by weight, based on the pigment amount.

To prepare the paper coating slip, the ingredients are mixed conventionally, with the (co)polymer being used generally in the form of a dispersion, suspension or solution.

The amount of water in the paper coating slip is usually adjusted to from 25 to 75% by weight, based on the overall paper coating slip (including water).

The paper coating slip may be applied by customary techniques to the papers to be coated (cf. Ullmann's Encyclopädie der Technischen Chemie, 4th edition, Vol. 17, p. 603 ff).

If desired, a thickener may be added as well. Suitable thickeners include free-radically (co)polymerized (co) polymers and customary organic and inorganic thickeners such as hydroxymethylcellulose or bentonite.

In the majority of cases, the paper coating slips are aqueous slips. The water content may be adjusted in accordance with the desired viscosity or flow properties.

To prepare the paper coating slip, the ingredients may be mixed in a known manner. The paper coating slips of the invention are suitable for coating, for example, paper or board. The paper coating slip may then be applied to the papers or board by conventional techniques.

The papers or boards coated with the paper coating slips of the invention may be printed in customary processes, e.g., offset, letterpress or gravure printing processes.

The examples below are intended to illustrate the properties of the paper coating slips of the invention but without restricting the invention to these particular coating slips.

In this specification, parts are by weight unless otherwise specified.

EXAMPLE 1

A coating slip was prepared having the following composition:

70 parts of calcium carbonate (Hydrocarb® 90, Pl üss-Staufer AG)

30 parts of kaolin (Amazon 88, Kaolin International)

8 parts of styrene-butadiene latex (Styronal® D 610, BASF Aktiengesellschaft)

0.5 part of optical brightener (Blankophor® PSG, Bayer AG) and as cobinder:

0.5 part of carboxymethylcellulose (CMC 7L2T, Hercules GmbH) or 0.5 part of polyvinylformamide (PVFA) having a K value of 51 and a degree of hydrolysis as specified in table 1.

The coating slips, with a solids content of 68.1% by weight, were applied at a coat weight of 16 g/m$^2$ to chemical paper with a basis weight of 70 g/m$^2$ and the paper was then glazed.

The brightening of the paper was determined in accordance with DIN 53 145, part 2.

The CIE whiteness of the paper was measured in accordance with ISO 2469.

When determining the dry pick resistance in accordance with the IGT method using the Lorilleux ink 3808 at 85 cm/s, the ink density was determined using the Gretag densitometer.

When determining the wet pick resistance in accordance with using the test bench instrument using the Lorilleux ink 3804 at 35 cm/s, the ink density was determined using the Gretag densitometer.

Additionally, the 75° print gloss of the papers was measured by the Lehmann method.

The test results for the coated papers are given in table 1.

TABLE 1

| Cobinder | | CMC 7L2T | PVFA Degree of hydrolysis 0% | PVFA Degree of hydrolysis 3% | PVFA Degree of hydrolysis 8.5% |
|---|---|---|---|---|---|
| Whiteness R 457 with UV | % | 91.0 | 92.9 | 93.9 | 94.1 |
| Whiteness R 457 without UV | % | 85.9 | 86.4 | 87.0 | 87.1 |
| Brightening | % | 5.1 | 6.5 | 6.9 | 7.0 |
| Whiteness CIE | % | 102.3 | 109.2 | 111.4 | 111.3 |
| IGT dry (85 cm/s) | | 0.53 | 0.94 | 1.25 | 1.25 |
| Test bench wet (35 cm/s) | | 0.70 | 1.71 | 1.81 | 1.55 |
| Print gloss | % | 69.5 | 71.8 | 72.1 | 76.6 |

The coating slips of the invention which comprise a polyvinylformamide (PVFA) experience greater optical brightening and possess a higher CIE whiteness than the coating slips which, in accordance with the prior art, comprise carboxymethylcellulose as cobinder. It is also evident that polyvinylformamides having undergone a certain degree of hydrolysis and therefore being cationic provide greater brightening and CIE whiteness than nonionic PVFA. Moreover, it can be seen that the coating compositions that include a polyvinylformamide have much better properties in terms of both dry and wet pick resistance than those comprising CMC as cobinder. Finally, the coating slips of the invention also produce a markedly higher print gloss.

EXAMPLE 2

A coating slip was prepared having the following composition:

70 parts of calcium carbonate (Hydrocarb 90, Plüss-Staufer AG)

30 parts of kaolin (Amazon 88, Kaolin International)

8 parts of styrene-butadiene latex (Styronal® D 615, BASF Aktiengesellschaft)

0.5 part of optical brightener (Blankophor PSG, Bayer AG)

The cobinders used were as follows:

0.5 part of carboxymethylcellulose (CMC 7L2T, Hercules GmbH) or 0.5 part of polyvinyl alcohol (Mowiol® 6–98, Clariant Aktiengesellschaft) or 0.5 and 1.0 part of polyvinylformamide (PVFA) having a K value of 45 and a degree of hydrolysis of 5%.

The coating slips were processed as described in example 1.

The brightening and whiteness of the glazed papers, and the print gloss, were determined as described in example 1.

The test results are set out in table 2.

TABLE 2

| Cobinder | | none | CMC 7L2T 0.5% | Polyvinyl alcohol Mowiol 6–98 0.5% | Cationic PVFA Degree of hydrolysis 5% 0.5% | Cationic PVFA Degree of hydrolysis 5% 1.0% |
|---|---|---|---|---|---|---|
| Whiteness R 457 with UV | % | 89.8 | 91.2 | 93.0 | 94.3 | 95.0 |
| Whiteness R 457 without UV | % | 85.0 | 85.8 | 86.1 | 87.0 | 86.8 |
| Brightening | % | 4.8 | 5.4 | 6.9 | 7.3 | 8.2 |
| Whiteness CIE | % | 99.3 | 103.5 | 111.0 | 113.1 | 116.6 |
| Print gloss | % | 72.6 | 72.2 | 70.2 | 73.8 | 75.5 |

Table 2 reveals that the coating slips of the invention containing polyvinylformamide produce a higher whiteness and a greater print gloss than the coating slips that contain other cobinders.

EXAMPLE 3

A coating slip was prepared having the following composition:

70 parts of calcium carbonate (Hydrocarb 90, Plüss-Staufer AG)

30 parts of kaolin (Amazon 88, Kaolin International)

8 parts of styrene-butadiene latex (Styronal® PR 8736, BASF Aktiengesellschaft)

0.5 part of optical brightener (Blankophor PSG, Bayer AG)

The cobinders used were as follows:

1.0 part of carboxymethylcellulose (CMC 7L2T, Hercules GmbH) or 1.0 part of acrylic-based copolymer (Acrosol® C 50 L, BASF Aktiengesellschaft) or 1.0 part of polyvinylformamides (PVFA) having a K value of 50 and a degrees of hydrolysis of 1% and 5%.

The coating slips were processed as described in example 1.

The brightening and whiteness of the glazed papers, and their dry and wet pick resistances, were determined as described in example 1.

The test results are set out in table 3.

TABLE 3

| Cobinder | | CMC 7L2T | Acrosol C 50 L | PVFA Degree of hydrolysis 1% | PVFA Degree of hydrolysis 5% |
|---|---|---|---|---|---|
| Whiteness R 457 with UV | % | 91.9 | 92.7 | 93.4 | 94.3 |
| Whiteness R 457 without UV | % | 86.2 | 86.3 | 86.1 | 86.5 |
| Brightening | % | 5.7 | 6.4 | 7.3 | 7.8 |
| Whiteness CIE | % | 105.3 | 107.8 | 111.6 | 113.8 |
| Test bench wet (130 cm/s) | | 0.55 | 0.52 | 1.44 | 1.21 |

The results set out in table 3 confirm that using the coating slips of the invention prepared with the additives described gives rise to papers having higher whiteness and greater strength than when using coating slips comprising prior art cobinders.

EXAMPLE 4

A coating slip was prepared having the following composition:

70 parts of calcium carbonate (Hydrocarb 90, Plüss-Staufer AG)

30 parts of kaolin (Amazon 88, Kaolin International)

10 parts of styrene-acrylate latex (Acronal® S 360 D, BASF Aktiengesellschaft)

0.5 part of carboxymethylcellulose (CMC 7L2T, Hercules GmbH) as cobinder for all formulas 0.5 part of optical brightener (Blankophor PSG, Bayer AG)

As an additional cobinder the following were used:

0.5 part of carboxymethylcellulose (CMC 7L2T, Hercules GmbH) or 0.5 part of polyvinylformamide (PVFA) having a K value of 69 and a degree of hydrolysis of 1%.

The coating slips were processed as described in example 1.

The brightening and whiteness of the glazed papers and their dry and wet pick resistances were determined as described in example 1.

The test results are reproduced in table 4.

TABLE 4

| Additional cobinder | | CMC 7L2T | PVFA K value 69 Degree of hydrolysis 1% |
|---|---|---|---|
| Whiteness R 457 with UV | % | 94.0 | 95.8 |
| Whiteness R 457 without UV | % | 87.4 | 88.5 |
| Brightening | % | 6.6 | 7.3 |
| Whiteness CIE | % | 110.7 | 111.6 |
| IGT dry (170 cm/s) | | 1.35 | 1.80 |
| Test bench wet (130 cm/s) | | 0.78 | 1.28 |

The results in table 4 show that the coating slips of the invention produce an improvement even when they already contain a conventional cobinder, the addition of the novel additive making the quality of the coated paper much higher than when the same amount of the cobinder already present in the slip is added.

EXAMPLE 5

A coating slip was prepared having the following composition:

| | |
|---|---|
| 70 parts | of calcium carbonate (Hydrocarb 90, Plüss-Staufer AG) |
| 30 parts | of kaolin (Amazon 88, Kaolin International) |
| 10–12 parts | (see table 5) of styrene-butadiene latex (Styronal LD 615, BASF Aktiengesellschaft) |
| 0.5 part | of optical brightener (Blankophor PSG, Bayer AG) |

Sterocoll® FD as indicated in table 5.

The cobinders used were as follows:

1.0 part of oxidatively degraded starch (Emox® TSC, Emsland-Stärke GmbH) or 2.0 parts of oxidatively degraded starch (Emox TSC, Emsland-Stärke GmbH) or 0.5 part of polyvinylformamide (PVFA) with a K value of 69 and a degree of hydrolysis (DH) of 1% and 5% respectively.

The coating slips were processed as described in example 1.

The brightening and whiteness of the glazed papers and their wet pick resistances were determined as described in example 1.

The blister resistance was determined by immersing the papers, coated on both sides, in hot oil (240° C.). The blistering was assessed with a rating from 1 (no blisters) to 6 (very many blisters).

The test results are set out in table 5.

TABLE 5

| | | | | | | |
|---|---|---|---|---|---|---|
| Parts of Styronal LD 615 | | 12 | 11 | 10 | 11 | 11 |
| Parts of Sterocoll FD | | 0.30 | 0.25 | 0.2 | 0.5 | 0.5 |
| Cobinder (parts) | | — | Oxid. starch (1.0) | Oxid. starch (2.0) | PVFA DH 1% (0.5) | PVFA DH 5% (0.5) |
| Whiteness R 457 with UV | % | 92.2 | 92.9 | 92.6 | 94.5 | 93.4 |
| Brightening | % | 4.5 | 4.8 | 4.7 | 6.2 | 6.4 |
| Whiteness CIE | % | 100.8 | 103.2 | 103.4 | 108.6 | 109.4 |
| Test bench wet (135 cm/s) | | 1.11 | 1.32 | 0.93 | 1.69 | 1.21 |
| Blistering at 240° C. | | 6 | 3 | 5 | 1 | 2 |

Table 5 reveals that although degraded starches likewise increase the whiteness of the paper, they fail to achieve the effectiveness in this respect of the much smaller amounts of polyvinylformamides. It is also evident that the papers produced using polyvinylformamides as cobinders combine an equivalent or higher wet pick resistance with a substantially reduced blistering tendency in comparison with the papers produced using starch.

EXAMPLE 6

A coating slip was prepared having the following composition:

70 parts of calcium carbonate (Hydrocarb 90, Plüss-Staufer AG)

30 parts of kaolin (Amazon 88, Kaolin International)

8 parts of styrene-butadiene latex (Styronal D 610, BASF Aktiengesellschaft)

0.5 part of optical brightener (Blankophor PSG, Bayer AG)

The following cobinders were used:

0.5 part of carboxymethylcellulose (CMC 7L2T, Hercules GmbH) or 0.5 part of a copolymer of vinylformamide and acrylic acid (VFA/AA) in a ratio of 80:20 with a K value of 38 or 0.5 part of a copolymer of vinylformamide and acrylic acid (VFA/AA) in a ratio of 90:10 with a K value of 43.

The coating slips were processed as described in example 1.

The brightening and whiteness of the glazed papers were determined as described in example 1.

The test results are recorded in table 6.

TABLE 6

| Cobinder | | CMC 7L2T | 80:20 VFA/AA copolymer | 90:10 VFA/AA copolymer |
|---|---|---|---|---|
| Whiteness R 457 with UV | % | 91.3 | 91.6 | 92.4 |
| Whiteness R 457 without UV | % | 85.9 | 86.1 | 86.2 |
| Brightening | % | 5.1 | 5.5 | 6.2 |
| Whiteness CIE | % | 102.3 | 104.6 | 106.7 |

The tests show that even the addition of anionic polyvinylformamides produces coating slips which give rise to papers with greater whiteness than coating slips containing prior art cobinders.

EXAMPLE 7

A coating slip was prepared having the following composition:

70 parts of calcium carbonate (Omyalite® 90, Plüss-Staufer AG)

30 parts of kaolin (Amazon 88, Kaolin International)

10 parts of styrene-acrylate latex (Acronal S 305 D, BASF Aktiengesellschaft)

0.5 part of optical brightener (Blankophor PSG, Bayer AG)

The cobinders used were as follows:

2 parts of polyvinyl alcohol (Polyviol® LL 603, Wacker-Chemie GmbH) or 3.5 parts of oxidatively degraded starch (Emox TSC, Emsland-Stärke GmbH) or 2 parts of polyvinylformamide (PVFA) having a K value of 32 and degrees of hydrolysis of 0%, 1% and 5% respectively.

The coating slips were processed as described in example 1.

The brightening and whiteness of the glazed papers and their dry and wet pick resistances, were determined as described in example 1.

The test results are set out in table 7.

TABLE 7

| Cobinder | | Polyvinyl alcohol | Oxid. Starch | PVFA degree of hydrolysis 0% | PVFA Degree of hydrolysis 1% | PVFA Degree of hydrolysis 5% |
|---|---|---|---|---|---|---|
| Whiteness R 457 with UV | % | 94.0 | 92.2 | 95.2 | 96.0 | 95.6 |
| Whiteness R 457 without UV | % | 86.4 | 86.1 | 86.8 | 87.4 | 87.2 |
| Brightening | % | 7.6 | 6.1 | 8.4 | 8.6 | 8.4 |

Table 7 shows that even the addition of nonionic and cationic polyvinylformamides having a low molecular weight (K value) to coating slips produces papers having greater optical brightening than can be achieved by adding prior art cobinders.

What is claimed is:

1. A process comprising applying a composition comprising at least one addition polymer or copolymer comprised of polymerized units of:

from 1 to 100 parts by weight of N-vinylformamide, from 0 to 10 parts by weight of at least one water-soluble cationic monomer, from 0 to 30 parts by weight of at least one monoethylenically unsaturated carboxylic acid monomer unit selected from the group consisting of acrylic acid, methacrylic acid, dimethylacrylic acid, ethacrylic acid, maleic acid, citraconic acid, methylenemalonic acid, allylacetic acid, vinylacetic acid, crotonic acid, fumaric acid, mesaconic acid, itaconic acid and the water soluble salts thereof, and from 0 to 90 parts by weight of an additional water-soluble vinyl monomer, and one or more optical brighteners to paper, wherein the stated amount of units of N-vinylformamide is sufficient to achieve an increased brightening effect of the paper and an increased dry and wet strength of the paper.

2. The process as claimed in claim 1, wherein the composition further comprises at least one white pigment and at least one binder.

3. The process as claimed in claim 1, wherein the at least one water-soluble cationic monomer is a member selected from the group consisting of N-trialkylammoniumalkylacrylamide, N-trialkylammoniumalkylmethacrylamide, diallyldimethylammonium chloride, diallyldiethylammonium methosulfate, N-(2-trimethylammonium)ethylacrylamide methosulfate, N-2-ethyldimethylammonium) ethylmethacrylamide ethosulfate and mixtures thereof.

4. The process as claimed in claim 1, wherein the acid monomer is acrylic acid or methacrylic acid or a salt thereof.

5. The process as claimed in claim 1, wherein the units of a water soluble monomer are selected from the group consisting of N-vinylpyrrolidone, N-vinylcaprolactam, N-vinyl-N-alkylcarboxamides and N-vinyl-carboxamides.

6. The process as claimed in claim 5, wherein the units of water soluble monomer are of N-vinylpyrrolidone.

7. The process as claimed in claim 1, wherein the polymerized N-vinylformamide units are partially cleaved by hydrolysis at a temperature of 20 to 200° C. by acid or base.

8. The process as claimed in claim 7, wherein the polymerized N-vinylformamide units are partially cleaved by acid hydrolysis at a pH of 2 to 0 or by alkaline hydrolysis at a pH of 11 to 14.

9. A paper obtained by the process as claimed in claim 1.

10. A paper coating slip comprising at least one binder, at least one white pigment, an optical brightener, and a polymer comprised of polymerized units of:

from 1 to 100 parts by weight of N-vinylformamide, from 0 to 10 parts by weight of at least one water-soluble cationic monomer, from 0 to 30 parts by weight of at least one monoethylenically unsaturated carboxylic acid monomer unit selected from the group consisting of acrylic acid, methacrylic acid, dimethylacrylic acid, ethacrylic acid, maleic acid, citraconic acid, methylenemalonic acid, allylacetic acid, vinylacetic acid, crotonic acid, fumaric acid, mesaconic acid, itaconic acid and the water soluble salts thereof, and from 0 to 90 parts by weight of an additional water-soluble vinyl monomer, wherein the stated amount of units of N-vinylformamide is sufficient to achieve an increased brightening effect and an increased dry and wet strength when applied to paper.

11. A paper coating slip as claimed in claim 10, wherein the polymer is present in an amount ranging from 0.2 to 10 parts by eight per 100 parts by weight of pigment.

12. A paper coated with the slip as claimed in claim 10.

13. A process, comprising:

applying an ink to a paper comprising the paper coating slip of claim 10.

14. A process comprising applying a composition comprising at least one addition polymer or copolymer comprised of polymerized units of:

from 1 to 100 parts by weight of N-vinylformamide, from 0to 10 parts by weight of at least one water-soluble cationic monomer, from 0 to 30 parts by weight of at least one of acrylic acid, methacrylic acid, mixtures thereof and the water soluble salts thereof, and from 0 to 90 parts by weight of an additional water-soluble vinyl monomer, and one or more optical brighteners to paper, wherein the stated amount of units of N-vinylformamide is sufficient to achieve an increased brightening effect of the paper and an increased dry and wet strength of the paper.

15. A paper coating slip comprising at least one binder, at least one white pigment, an optical brightener, and a polymer comprised of polymerized wilts of:

from 1 to 100 parts by weight of N-vinylformamide, from 0 to 10 parts by weight of at least one water-soluble cationic monomer, from 0 to 30 parts by weight of at least one of acrylic acid, methacrylic acid, mixtures thereof and the water soluble salts thereof, and from 0 to 90 parts by weight of an additional water-soluble vinyl monomer, wherein the stated amount of units of N-vinylformamide is sufficient to achieve an increased brightening effect and an increased dry and wet strength when applied to paper.

* * * * *